US010655915B2

(12) United States Patent
Shortt et al.

(10) Patent No.: US 10,655,915 B2
(45) Date of Patent: May 19, 2020

(54) PELLET DRYER WITH ADDITIONAL BLOWER

(71) Applicant: GALA INDUSTRIES, INC., Eagle Rock, VA (US)

(72) Inventors: Louis Cody Shortt, Vinton, VA (US); Richard Borland Thrasher, Jr., Troutville, VA (US); Kerry Patrick Morris, Troutville, VA (US)

(73) Assignee: GALA INDUSTRIES, INC., Eagle Rock, VA (US)

( * ) Notice: Subject to any disclaimer, the term of this patent is extended or adjusted under 35 U.S.C. 154(b) by 711 days.

(21) Appl. No.: 15/293,890

(22) Filed: Oct. 14, 2016

(65) Prior Publication Data

US 2018/0106541 A1 Apr. 19, 2018

(51) Int. Cl.

| | |
|---|---|
| ***F26B 5/08*** | (2006.01) |
| ***F26B 21/12*** | (2006.01) |
| ***F26B 3/06*** | (2006.01) |
| ***F26B 17/22*** | (2006.01) |

(52) U.S. Cl.

CPC ..... *F26B 21/12* (2013.01); *F26B 3/06* (2013.01); *F26B 5/08* (2013.01); *F26B 17/22* (2013.01)

(58) Field of Classification Search

CPC .... F26B 21/12; F26B 3/06; F26B 5/12; F26B 5/041; F26B 5/042; F26B 5/08; F26B 17/002; F26B 17/00; F26B 17/22; F26B 17/007; F26B 17/008

USPC ..... 34/312, 318, 361, 92

See application file for complete search history.

(56) References Cited

U.S. PATENT DOCUMENTS

| | | | | |
|---|---|---|---|---|
| 3,458,945 | A | 8/1969 | Edwards | |
| 4,565,015 | A | 1/1986 | Hundley, III | |
| 4,896,435 | A | 1/1990 | Spangler, Jr. | |
| 5,245,345 | A | 9/1993 | Bonta et al. | |
| 6,438,866 | B1 | 8/2002 | Meydell et al. | |
| 6,467,188 | B1 | 10/2002 | Sandford | |
| 6,505,416 | B2 | 1/2003 | Sandford | |
| 8,365,430 | B2 | 2/2013 | Veltel et al. | |
| 2003/0033725 | A1 * | 2/2003 | Humphries, II | F26B 5/08 34/58 |

(Continued)

FOREIGN PATENT DOCUMENTS

| | | |
|---|---|---|
| DE | 4330078 | 3/1994 |

*Primary Examiner* — John P McCormack

(74) *Attorney, Agent, or Firm* — Jacobson Holman, PLLC.

(57) ABSTRACT

The invention relates to a pellet dryer (1) comprising: a housing (2), an inlet for feeding fluid flushed pellets and two separate outlets (3, 10) for discharging the dried pellets and the fluid, a vertical bladed rotor (4) for separation of the fluid by a screen (5) toward outside of the screen (5) surrounding the bladed rotor (4) and for a vertical acceleration and separation of the pellets by the blades (6) of the bladed rotor (4) and for continuously drying the vertically accelerated pellets inside the screen (5) of the housing (2), wherein an additional blower (18) is provided comprising a fan on top of the housing (2) positioned in the periphery of the bladed rotor (4) and connected with a ductwork (20) inside the housing (2) between an inner surface (16) of the housing (2) and an outer surface (38) of a framework (39) of the screen (5), wherein the rotational speed of the additional blower (18) is controlled by a central controller unit of the pellet dryer (1) independently of the rotational speed of the bladed rotor (4).

19 Claims, 7 Drawing Sheets

(56) References Cited

U.S. PATENT DOCUMENTS

| | | | | |
|---|---|---|---|---|
| 2006/0080855 | A1* | 4/2006 | Roberts | B29B 9/16 34/59 |
| 2009/0309247 | A1* | 12/2009 | Mann | B29B 9/06 264/14 |
| 2012/0024760 | A1* | 2/2012 | Hefner | F26B 1/00 209/3 |
| 2013/0036625 | A1* | 2/2013 | Muerb | F26B 17/24 34/587 |

* cited by examiner

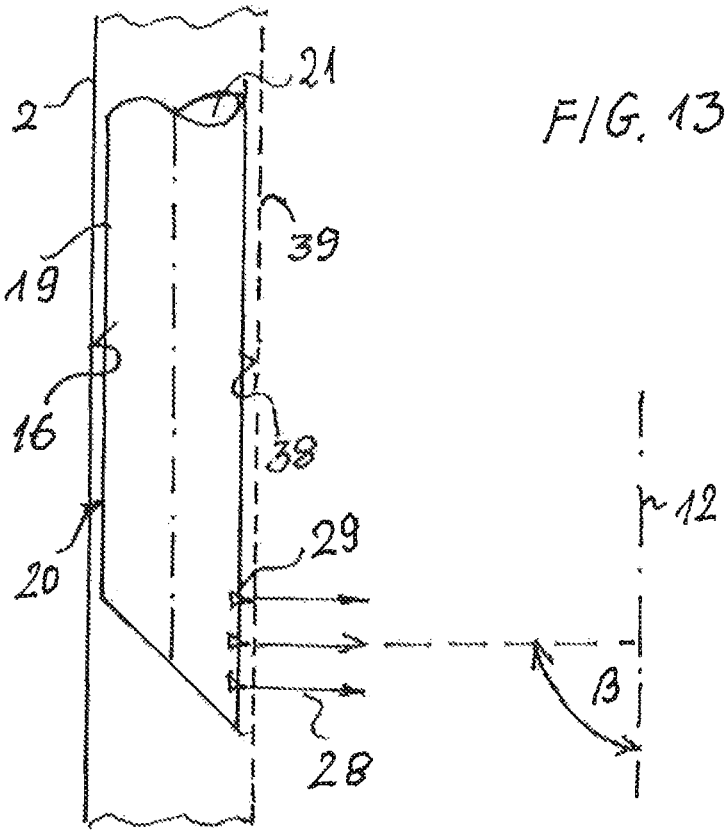
FIG. 13
FIG. 14
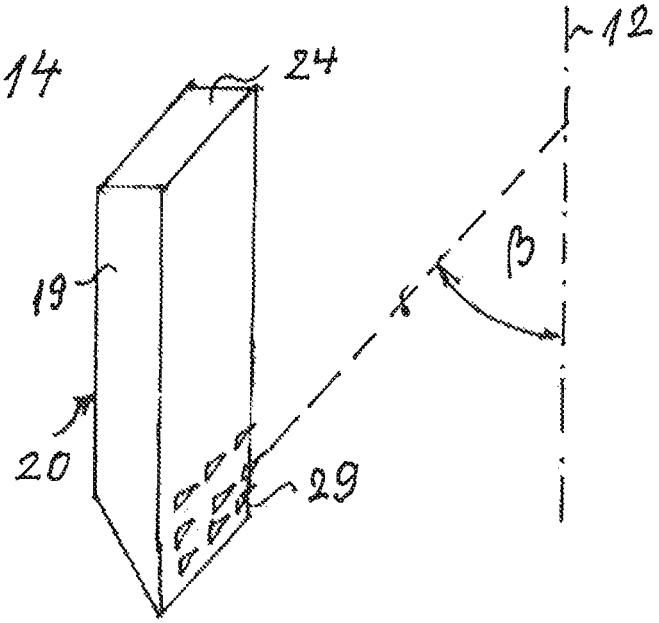

PELLET DRYER WITH ADDITIONAL BLOWER

TECHNICAL FIELD

The present disclosure generally relates to pellet dryer and more particularly relates to a pellet dryer with an additional blower.

BACKGROUND

Centrifugal pellet dryers of both vertical and horizontal type are well known in the state of the art and include an outer housing, a screen oriented in the housing and a bladed rotor mounted in the screen for moving a slurry of fluid and pellets within the screen, to enable a discharge of fluid through the screen. A slurry inlet is provided along with two outlets for Fluid and dried pellets. Centrifugal pellet dryers of the vertical type are disclosed in U.S. Pat. Nos. 3,458,945; 4,565,015; 4,896,435; 5,245,347 commonly owned by Gala Industries, Inc. In the operation of such dryers an exhaust fan as a blower at the upper end of the housing communicates directly with the interior of the dryer with the dryer rotor shaft extending upwardly from the dryer and being connected with the bladed rotor, so that the fan of the blower and the bladed rotor are driven by the same rotor. The blower produces a countercurrent flow of drying air through the pellet discharge outlet duct.

One problem of such pellet dryer is control the drying of the pellets in respect to the main rotational speed of the driver of the bladed rotor optimized in respect to an upward accelerating of the pellets by the blades of the rotor, which dictates contemporary the amount of the countercurrent flow of drying air in a contrarious direction to the upward accelerated pellets which is difficult to balance in an optimized way for both, the optimization of upward acceleration of pellets and optimization of drying the pellets by an optimized air flow.

SUMMARY OF THE INVENTION

An object of the present invention is to improve the drying of the pellets. Another object of the present invention is to avoid any stacking of pieces of pellets in the screen followed by an agglomeration of pellets in parts on the screen or at parts of the transition range for pellets from the screen toward a pellet outlet of the pellet dryer. A further object of the invention is to provide a centrifugal pellet dryer in accordance with the preceding objects that this pellet dryer does not require any additional floor space, any additional supporting structure thereby reducing overall cost. Still a further object of the invention is to decrease maintenance cost and elongate maintenance intervals of the pellet dryer.

These objects are solved by the subject matter of independent claim 1 and features of dependent claims. Furthermore, other desirable features and characteristics of the present invention will be apparent from the subsequent detailed description and the appended claims, taken in conjunction with the accompanying drawings and the foregoing technical field and background.

In accordance with an exemplary embodiment a pellet dryer comprising: a housing, an inlet for feeding fluid flushed pellets and two separate outlets for discharging the dried pellets and the fluid, a vertical bladed rotor for centrifugal separation of the fluid by a screen toward outside of the screen surrounding the bladed rotor and for a vertical acceleration and separation of the pellets by the blades of the bladed rotor and for continuously drying the vertically accelerated pellets inside the screen of the housing, wherein an additional blower is provided comprising a fan on top of the housing positioned in the periphery of the bladed rotor and connected with a ductwork inside the housing between an inner surface of the housing and an outer surface of the screen, wherein the rotational speed of fan of the additional blower is controlled by a central controller unit of the pellet dryer independently of the rotational speed of the bladed rotor.

SHORT DESCRIPTION OF THE DRAWINGS

The present disclosure will hereafter be described in conjunction with the following drawing figures, wherein like numerals denote like elements, and wherein:

FIG. 13 is a partial perspective side view of the ductwork having the cross sectional area of the ductwork of FIG. 5;

FIG. 14 is a partial perspective side view of the ductwork having the cross sectional area of the ductwork of FIG. 5.

DETAILED DESCRIPTION OF THE PREFERRED EMBODIMENTS

Figure 1:
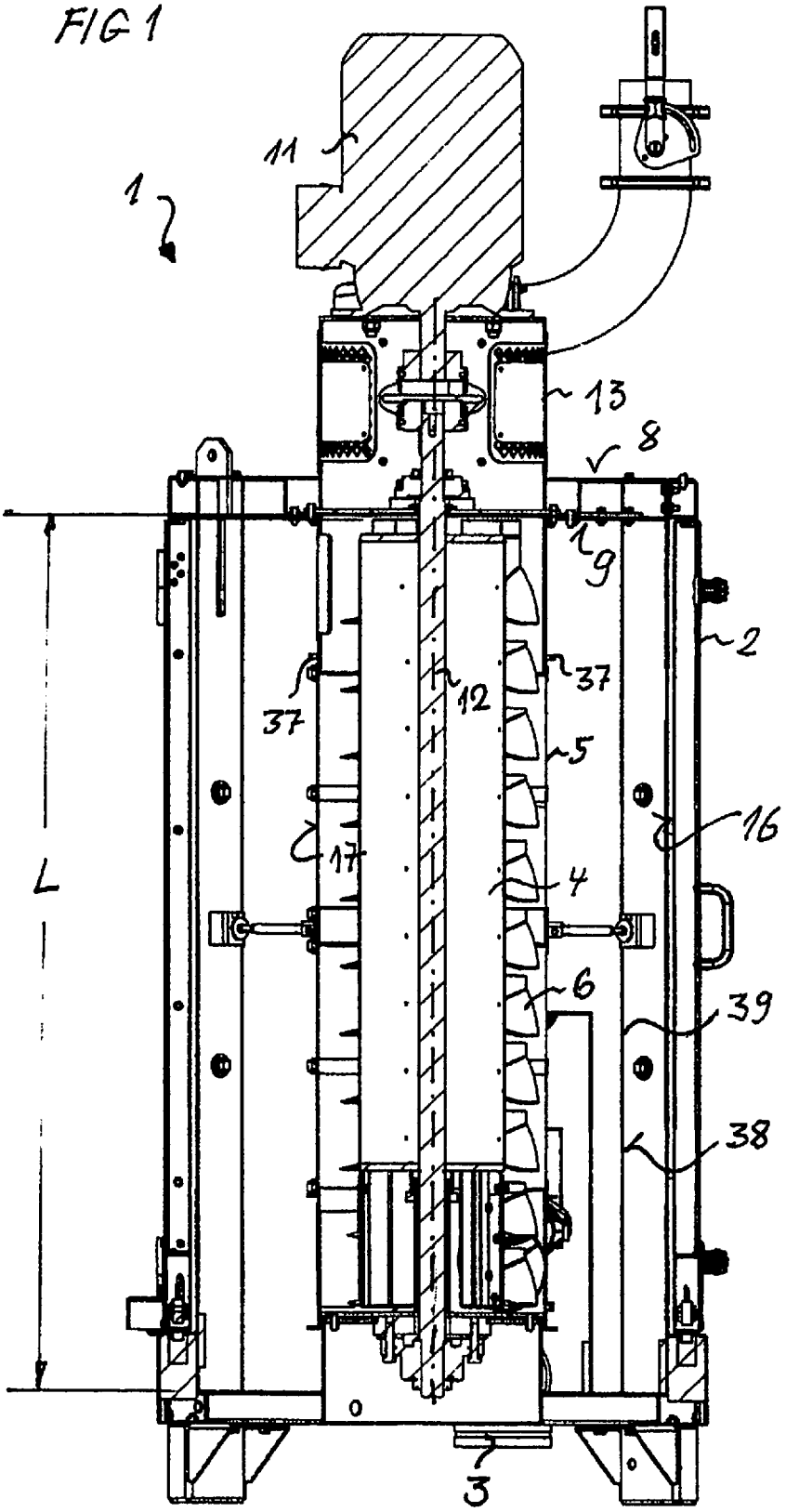
FIG. 1 is a cross sectional view of the pellet dryer according to an embodiment of the invention.
Figure 2:
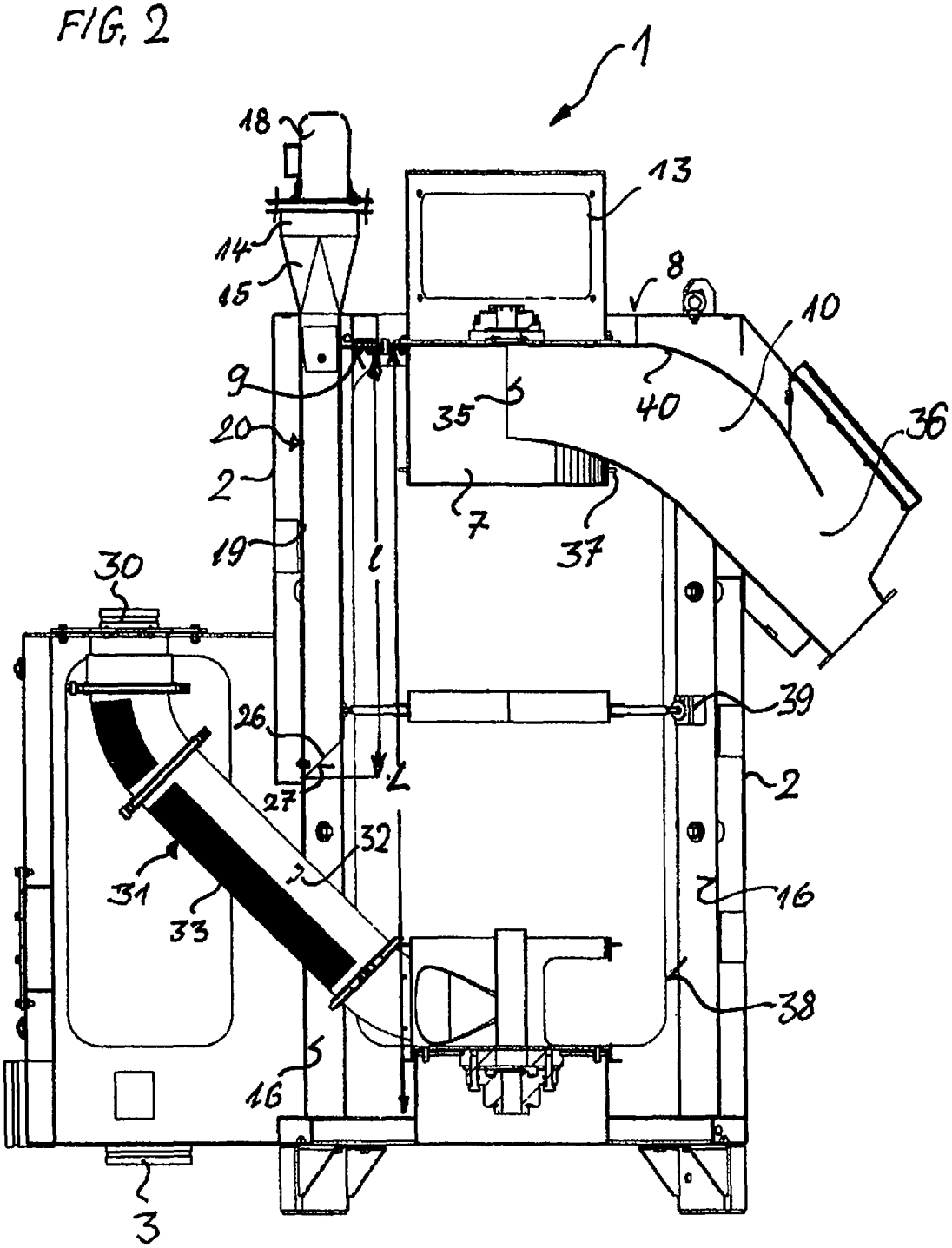
FIG. 2 is a side view of the pellet dryer according to the embodiment of the invention shown in FIG. 1.

Referring now to the drawings FIGS. 1 and 2 illustrate two different views of a centrifugal pellet dryer 1 of the vertical type according to an embodiment of the invention. The pellet dryer 1 comprises a vertical housing 2 of generally cylindrical configuration and supported in any suitable manner. A slurry of pellets and fluid enters the pellet dryer 1 through a slurry inlet 30 shown in FIG. 2 for feeding fluid flushed pellets and impinges against a fluid separator 31 in the form of an inclined and partially screened tube 32 which deflects the pellets with most of the fluid passing through the screen 33 of the tube 32 and out through a first outlet 3 of the housing 2 for the fluid.

The remaining moisture and fluid is separated from the pellets by centrifugal force applied to the remaining moisture and fluid by a vertically arranged bladed rotor 4 and a separating central screen 5 shown in FIG. 1 surrounding the bladed rotor 4 inside the housing 2. Blades 6 of the bladed rotor 4 accelerate the pellets upwards together with a continuously drying downwards air flow in the housing 2. A sleeve 7 is attached to an outer top 8 of the housing 2, so that the dried pellets could be guided to a second outlet 10 close to an inner top 9 of the housing 2 for discharging the dried pellets whilst the centrifugally separated fluid is discharged through the screen 5 toward outside the screen 5 to the first outlet 3 of the housing 2. The bladed rotor 4 is driven by one motor 11 above of a cover 13, the motor 11 being attached centrally on the outer top 6 of the housing 2 comprising one central axis 12 to provide a rotational speed.

Figure 3:
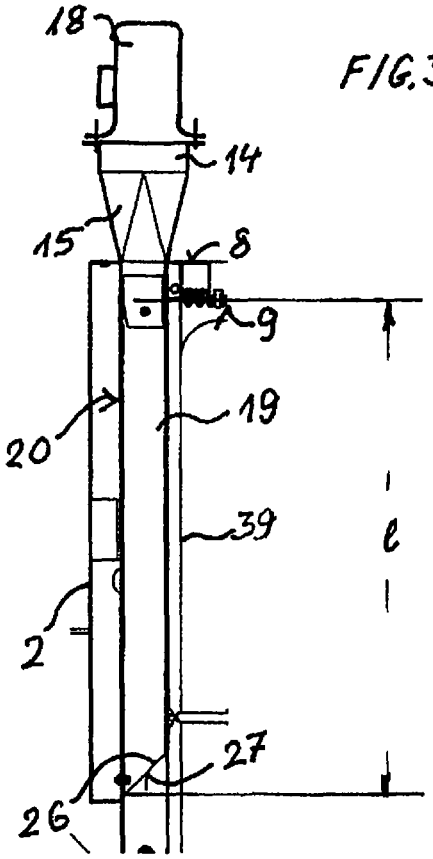
FIG. 3 is a partial side view of the ductwork having the cross sectional area of the ductwork of FIG. 4 is a cross sectional area of the ductwork of an embodiment of the invention.

As shown in FIG. 2 and in details in FIG. 3 an additional blower 18 is provided comprising a separated fan separately positioned in the periphery of the sleeve 7. As can be seen in FIG. 2 this pellet dryer 1 with the inventive additional blower 18 does not require any additional floor space since only a peripheral part of the outer top region 8 of the housing 2 is used for the montage and installation of the new inventive additional blower 18. This additional blower 18 is connected with a ductwork 20 inside the housing 2 in an available space between an inner surface 16 of the housing 2 and an outer surface 38 of the framework 39 of the central screen 5, so that again the inventive additional blower 18 with the complete new ductwork 20 inside the housing 2 does not require any additional floor space.

The rotational speed of the fan 14 of the additional blower 18 can be controlled by a known and not shown central controller unit of the pellet dryer 1 independently of the rotational speed of the bladed rotor 4 since the additional blower comprises an independent electric motor 18 as driver. Thus the additional blower 18 with ductwork 20 in the housing 2 provides advantageously an independent blowing of drying air to additionally control the drying of the pellets independently in respect to the main rotational speed of the motor 11 of the bladed rotor 4 which has to be optimized in respect to an upward accelerating of the pellets by the blades 6 of the bladed rotor 4, which in addition dictates the amount of the contrarious downward drying air flow in a contrarious downward direction to the upward accelerated pellets which is difficult to balance in an optimized way for both, the optimization of acceleration and optimization of drying the pellets by an optimized airflow.

Figure 4:
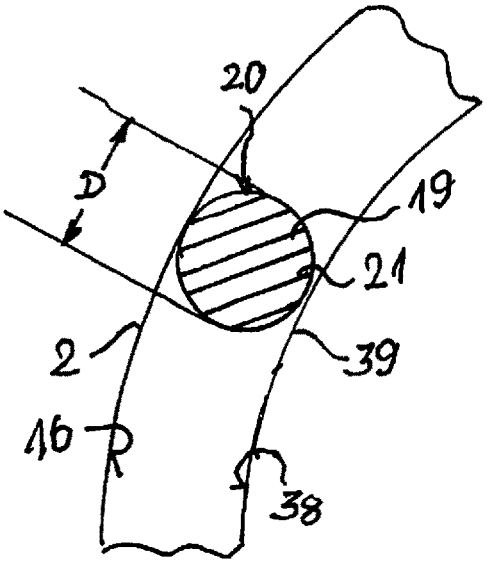

Due to the new additional blower 18 the drying and separating process of pellets out of a slurry of pellets and fluid can be optimized in a unique and simple way, since it is advantageously possible not only to increase the drying air flow, but also optimize the adjustment of the interference direction of additional air flow and main air flow by an optimized design of the ductwork 20. In one embodiment the ductwork 20 comprises a tube 19 as shown in FIG. 3 with a circular cross sectional area 21 as shown in FIG. 4 which has the advantage of simplification and low cost but with a close fitting limitation for an outer diameter D of the circular cross sectional area 21 limited by the radial difference of the curved inner surface 16 of the housing 2 and the outer surface 38 of the framework 39 of the central screen 5, as shown in FIG. 4.

In another embodiment of the present invention a guidance plate 40 is provided at the second outlet 10 of the housing 2 for dried pellets above an upper end 37 of the screen 5 additionally to the additional blower 18 with ductwork 20 in the housing 2 as shown in FIG. 2. Since an outlet duct 36 is attached to an opening 35 by an acute angle β in respect to the central axis 12 of the rotor 4 the guidance plate 40 should smooth a transition region between the end 37 of the screen 5 and the outlet duct 36 for guiding the pellets smoothly toward the outlet duct 36. Accordingly the second outlet 10 of the housing 2 for pellets comprises an opening 35 toward the inner top 9 of the housing 2 at an inner cylindrical side surface 16 of the housing 2 distant from the screen 5 in a radially outward direction and the outlet duct 36 is connected to the opening 35. The outlet guidance plate 40 of curved shape is provided close to the inner top 9 of the housing 2 inside the housing 2 wherein the outlet guidance plate 40 extends from a central position above the screen 5 through the outlet opening 35 into the outlet duct 36.

In a further embodiment the ductwork 20 of the additional blower 18 comprises a length l as shown in FIG. 3 between one third of the total internal vertical length L of the housing 2 shown in FIG. 2 and three quarter of the total internal vertical length L of the housing 2. This depends on the effect of the main continuous air flow, the higher the rotational speed of the bladed rotor 4 the deeper is the affected depth of drying pellets and consequently the length l of the tube 19 of the ductwork 20 of the additional blower 18 can be elongated up to three quarter of the total internal vertical length L of the housing 2. To the contrary the lower the rotational speed of the bladed rotor 4 the lower is the affected depth of drying pellets and consequently the length l of the tube 19 of the ductwork 20 of the additional blower 18 can be shortened down to three quarter of the total internal vertical length L of the housing 2. A compromise will be an embodiment, wherein the ductwork 20 comprises a length l of half of the internal vertical length L of the housing 2.

Figure 5:
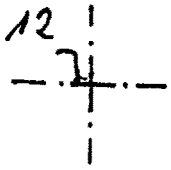
FIG. 5 is another cross sectional area of the ductwork of an embodiment of the invention.
Figure 5:
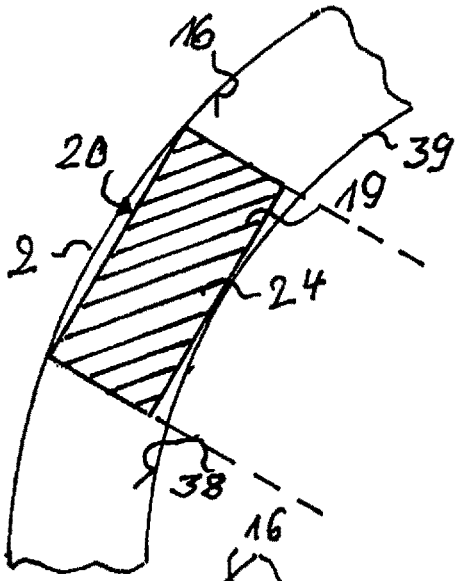

In a further embodiment the ductwork 20 comprises a tube 19 with a four-sided cross sectional area 24 as shown in FIG. 5 which can be optimized in its four-sided cross sectional area 24 between the inner surface 16 of the housing 2 and the outer surface 38 of the framework 39 of the central screen 5 by varying the relationship between the width of the pair of sides opposite to each other of the four-sided cross sectional area 24. Such an optimization can result in a larger cross sectional area compared to a circular tube as shown in FIG. 4.

Figure 6:
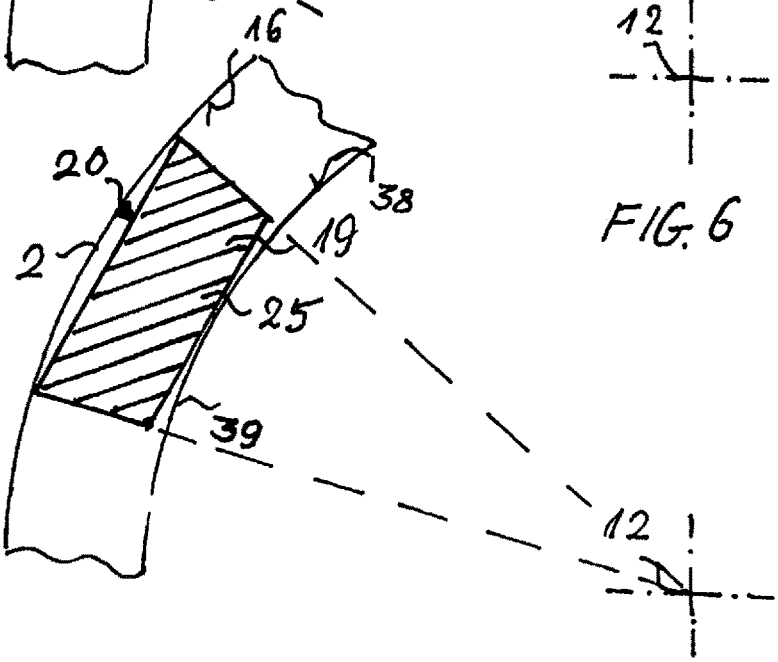
FIG. 6 is a further cross sectional area of the ductwork of an embodiment of the invention.

FIG. 6 illustrates a further cross sectional area of the ductwork of an embodiment of the invention. In FIG. 6 the ductwork 20 comprises a tube 19 with a trapezoidal cross sectional area 25 to fit between the inner surface 16 of the housing 2 and the outer surface 38 of the framework 39 of the central screen 5, wherein the inclined side lines of the trapezoid are preferably radially adjusted in respect to the central axis 12 of the bladed rotor 4 in FIG. 6.

Figure 7:
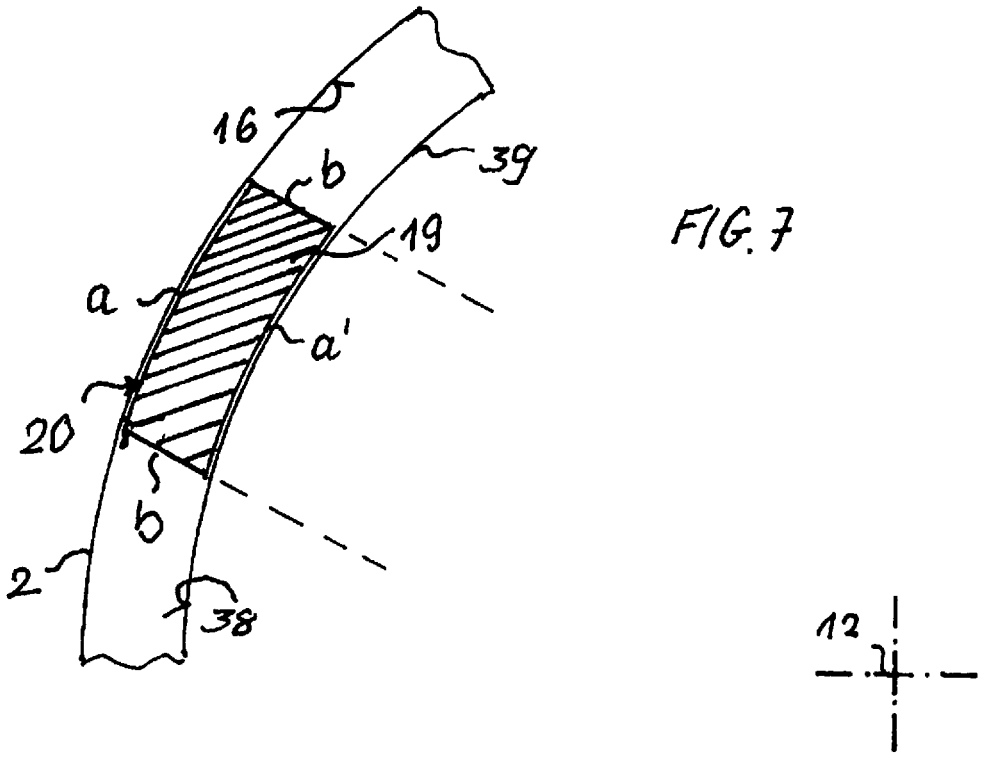
FIG. 7 is still another cross sectional area of the ductwork of an embodiment of the invention.
Figure 8:
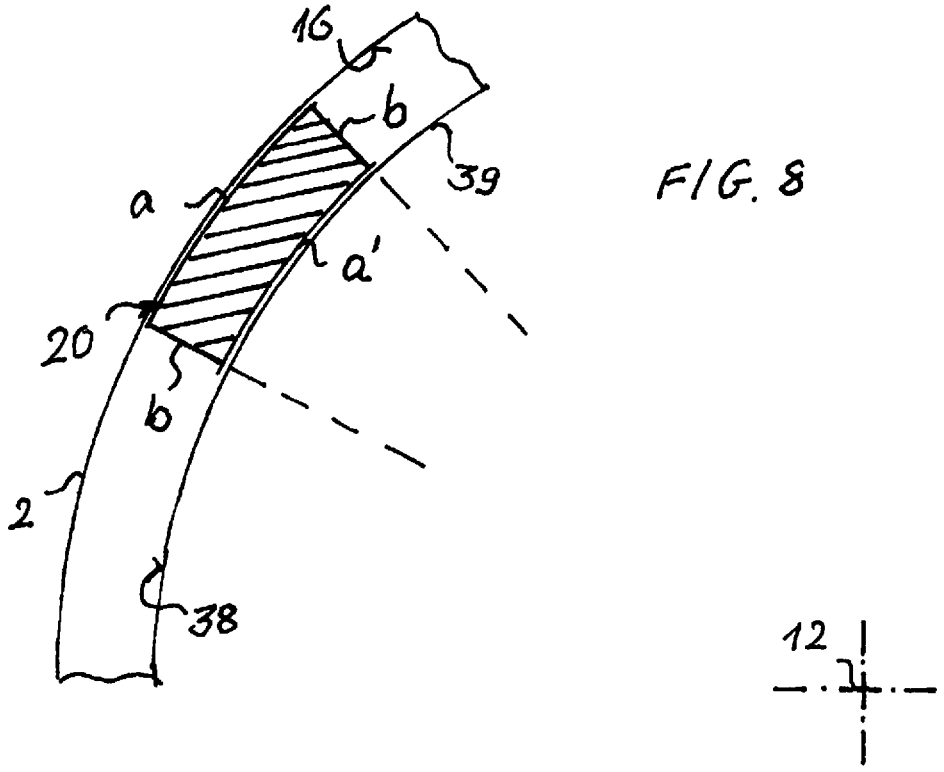
FIG. 8 is still a further cross sectional area of the ductwork of an embodiment of the invention.

The FIGS. 7 and 8 illustrate a ductwork 20 comprising a tube 19 with said four-sided cross sectional area like shown in FIGS. 5 and 6 but comprising two pairs each having walls a, a' and b, b arranged opposite to each other, wherein a first pair of walls a, a' arranged opposite to each other comprising two curved walls a and a' wherein one wall a is adapted to the curved inner surface 16 of the housing 2 and the other one a' of the opposite to each other arranged curved walls a, a' is adapted to the outer surface 38 of the framework 39 of the screen 5 and wherein the second pair of walls b, b arranged opposite to each other comprising straight walls b, b. The embodiment of FIG. 7 differs from FIG. 8 in that the straight walls b, b of FIG. 7 are parallel aligned parallel to each other whilst the straight walls b, b of FIG. 8 are radially aligned toward the central axis 12 of the bladed rotor.

In a further embodiment of the invention the ductwork 20 comprises an outlet opening 26 with an inclined open area 27 in respect to the direction of the central axis 12 of the bladed central rotor 4 as shown in the FIGS. 9 to 12 comprising an angle α of inclination between 30° and 60° preferably between 35° and 50°, so that the additional drying air flow of the additional blower 18 is directed contrariwise to the centrifugal direction of the moisture of fluid. The smaller the inclination angle α the wider and bigger will be the inclined open area of the outlet of the ductwork 20. Due to the inclined open area of the outlet of the ductwork 20 the additional drying air flow of the additional blower 18 is directed partially contrariwise to the centrifugal direction of the moisture of the fluid and specially contrariwise to a centrifugal component of the acceleration of the pellets by the blades of the bladed rotor toward the screen. This contrariwise directed additional air stream which flows radially toward the bladed rotor 4 helps to keep the screen 5 free of fixedly stacked pieces of pellets and can support to avoid any possible agglomeration of pellets at the inner surface of the screen 5, so that maintenance cost could decrease and the maintenance intervals of the pellet dryer 1 can be elongated.

Figure 9:
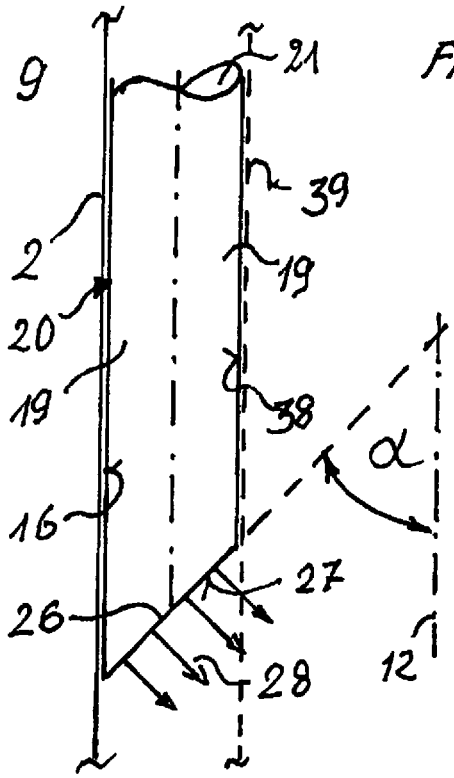
FIG. 9 is a partial side view of the ductwork having the cross sectional area of the ductwork of FIG. 4.
Figure 10:
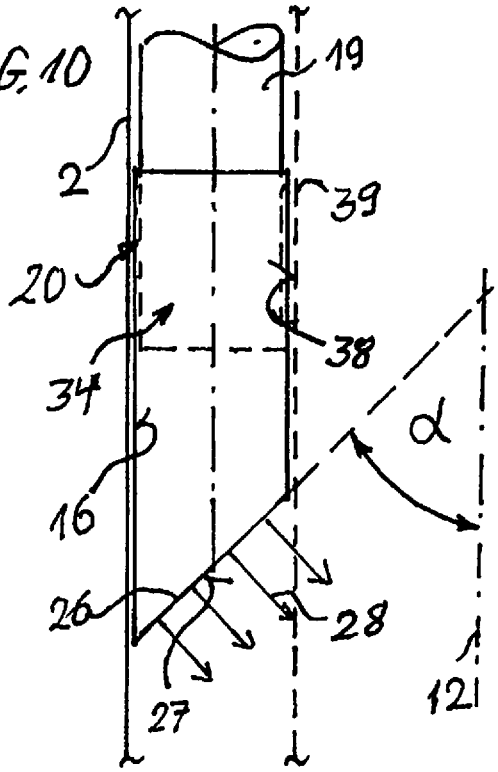
FIG. 10 is a partial side view of the ductwork having the cross sectional area of the ductwork of FIG. 4.

FIGS. 9 and 10 are partial side views of the ductwork 20 having the circular cross sectional area 21 of the ductwork 20 of FIG. 4 showing, that the direction of the air flow 28 has a declined direction comprising a radial flow vector and a downward directed flow vector. So that with a smaller declination angle α the radial vector will increase and with a larger inclination angle α the downward vector gets larger. The difference between FIG. 9 and FIG. 10 is that the ductwork 20 of FIG. 9 is a straight tube 19 of one piece, whilst the ductwork 20 of FIG. 10 comprises a telescope structure 34 comprising at least two parts partly moveably nested into each other so that the length of the ductwork can be adapted when operation conditions change.

Figure 11:
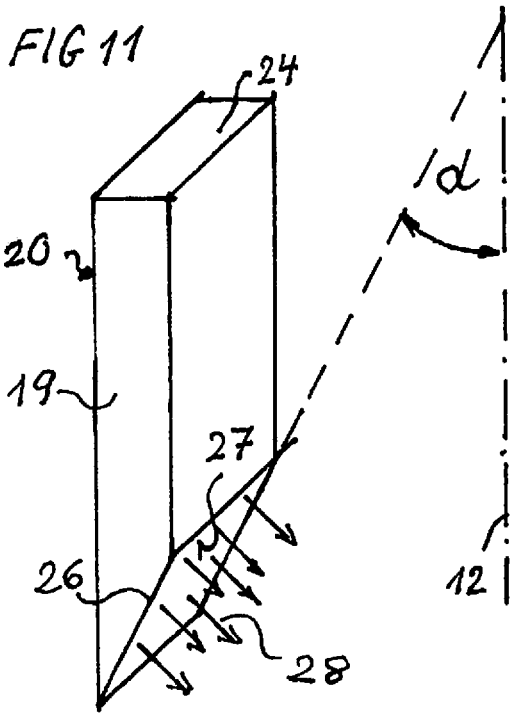
FIG. 11 is a partial perspective side view of the ductwork having the cross sectional area of the ductwork of FIG. 5.
Figure 12:
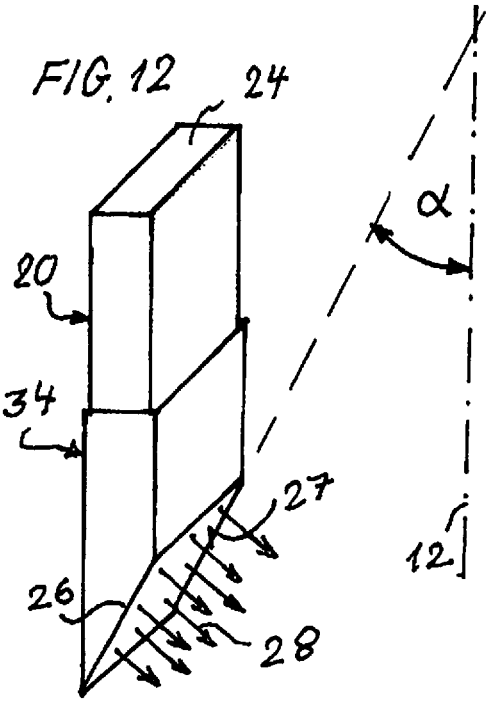
FIG. 12 is a partial perspective side view of the ductwork having the cross sectional area of the ductwork of FIG. 5.

FIGS. 11 and 12 are partial perspective views of the ductwork 20 having the four-sided cross sectional area 24 of the ductwork 20 of FIG. 5 showing, that the direction of the air flow 28 has a declined direction comprising a radial flow vector and a downward directed vector. So that with a smaller declination angle α the radial vector will increase and with a larger inclination angle α the downward vector gets larger. The difference between FIG. 11 and FIG. 12 is that the ductwork 20 of FIG. 11 is a straight tube 19 of one piece, whilst the ductwork 20 of FIG. 12 comprises a telescope structure 34 comprising at least two parts partly moveably nested into each other.

Another embodiment of the present invention comprises as an additional blower 18 an air compressor providing pressurized air into the ductwork 20 having outlet nozzles 29 inclined by the angle α up to 90° in a range of 15° to 90° in respect to the axes of the bladed rotor preferably 30° to 50° most preferably 45°. The air stream of nozzles 29 is stronger and more concentrated into a major direction than the inclined open outlet are as shown in the previous FIGS. 9 to 12. These nozzles shown in FIGS. 13 to 14 are more effective to keep the central screen 5 free of stacked pieces of pellets, so that maintenance cost could decrease further and the maintenance intervals of the pellet dryer 1 can be elongated further than without nozzles 29 supplied by pressurized air.

The foregoing detailed description of embodiments of the invention has been presented for purposes of illustration and description, but it is not intended to be exhaustive or limited to the invention as disclosed. Many modifications and variations will be apparent to those of ordinary skill in the art without departing from the scope and spirit of the invention defined by the claims, which includes known equivalents and foreseeable equivalents at the time of filing the application. The embodiments were chosen and described in order to best explain the principles of the invention and then practical application, and to enable others of ordinary skill in the art to understand the invention for various embodiments with various modifications as are suited to the particular use contemplated.

LIST OF REFERENCE SIGNS

1 centrifugal pellet dryer
2 vertical housing
3 first outlet of housing for fluid
4 bladed rotor
5 central screen
6 blades of bladed rotor
7 sleeve
8 outer top of housing
9 inner top of housing
10 second outlet of housing for pellets
11 main motor
12 central axis of fan and rotor
13 cover
14 adapter additional blower
15 support adapter
16 inner surface of the housing
17 outer surface of the central screen
18 additional blower
19 tube of ductwork
20 ductwork
21 circular cross sectional area
24 four-sided cross sectional area
25 trapezoidal
26 outlet opening of the ductwork
27 inclined open area
28 airflow direction
29 outlet nozzles
30 slurry inlet
31 separator
32 partially screened tube
33 inclined screen of the tube
34 telescopic tube
35 outlet opening
36 outlet duct of pellets
37 end of screen
38 outer surface of the framework of the screen
39 framework of central screen
40 guidance plate
a, a' pair of curved walls
b, b pair of straight walls
D diameter of circular cross section
l length of ductwork within the housing
L inner length of housing
α inclination angle of outlet opening in respect to the central axis
β inclination angle of nozzles in respect to the central axis

What is claimed is:

1. A pellet dryer comprising: a housing, an inlet for feeding fluid flushed pellets, and first and second outlets for discharging the fluid and the dried pellets, respectively, a bladed rotor having a central axis that extends in a vertical direction for separation of the fluid by a screen toward outside of the screen surrounding the bladed rotor and for a vertical acceleration and separation of the pellets by the blades of the bladed rotor and for continuously drying the vertically accelerated pellets inside the screen of the housing, characterized in that an additional blower is provided comprising fan on top of the housing positioned in the periphery of the bladed rotor and connected with a ductwork inside the housing between an inner surface of the housing and an outer surface of a framework of the screen, wherein the rotational speed of the additional blower is controlled by a central controller unit of the pellet dryer independently of the rotational speed of the bladed rotor.

2. The pellet dryer according to claim 1 wherein the ductwork comprises a tube with a circular cross sectional area.

3. The pellet dryer according to claim 1 wherein the ductwork comprises a tube with a four-sided cross sectional area.

4. The pellet dryer according to claim 1 wherein the ductwork comprises a tube with a trapezoidal cross sectional area.

5. The pellet dryer according to claim 3 wherein the four-sided cross sectional area includes a first pair of walls (a, a') arranged opposite to each other and a second pair of walls (b, b) arranged opposite to each other, the first pair of walls being two curved walls (a, a'), wherein one wall (a) of the first pair of walls is adapted to the inner surface of the housing and the other wall (a') of the first pair of walls is adapted to the outer surface of the framework of the screen and wherein the second pair of walls (b, b) have straight surfaces.

6. The pellet dryer according to claim 5 wherein the straight surfaces of the second pair of walls (b, b) of the ductwork are arranged in a radial direction.

7. The pellet dryer according to claim 5 wherein the straight surfaces (b, b) of the second pair of walls (b, b) of the ductwork are arranged parallel to each other.

8. The pellet dryer according to claim 1, wherein the ductwork comprises a length (1) between one third of the total internal vertical length (L) of the housing and three quarter of the total internal vertical length (L) of the housing.

9. The pellet dryer according to claim 1 wherein the ductwork comprises a length (l) of half of the internal vertical length (L) of the housing.

10. The pellet dryer according to claim 1 wherein the ductwork comprises a telescopic structure including at least two parts partly moveably nested into each other.

11. The pellet dryer according to claim 1 wherein the additional drying air flow of the additional blower is directed contrariwise to the direction of movement of the pellets.

12. The pellet dryer according to claim 1 wherein the ductwork comprises an outlet opening with an inclined open area in respect to the vertical direction of the central axis of the bladed rotor having an angle $\alpha$ of inclination between 30° and 60°.

13. The pellet dryer according to claim 1 wherein the ductwork comprises an outlet opening with an inclined open area in respect to the vertical direction of the central axis of the bladed rotor having an angle $\alpha$ of inclination of $\alpha$=45°.

14. The pellet dryer according to claim 1 wherein the additional blower comprises an air compressor providing pressurized air into the ductwork having outlet nozzles inclined by the angle $\alpha$ up to 90° in a range of 15° to 90° in respect to the vertical central axis of the bladed rotor.

15. The pellet dryer according to claim 1 wherein a guidance plate is provided above an upper end of the screen additionally to the additional blower with the ductwork in the housing at the second outlet of the housing for dried pellets.

16. The pellet dryer according to claim 1 wherein the pellet dryer includes an outlet opening toward an inner top of the housing at an inner cylindrical side surface of the housing distant from the screen in a radially outward direction and an outlet duct connected to the outlet opening, wherein the outlet duct is attached to the outlet opening by an acute angle $\beta$ in respect to the central axis of the bladed rotor and wherein an outlet guidance plate of curved shape is provided close to the inner top of the housing inside the housing in a transition region between an end of the screen and the outlet duct, said outlet guidance plate extending from a central position above the screen through the outlet opening into the outlet duct.

17. The pellet dryer according to claim 12 wherein the angle $\alpha$ of inclination is between 35 and 50°.

18. The pellet dryer according to claim 14 wherein the outlet nozzles are inclined by the angle $\alpha$ up to 90° in a range of 30° to 50° in respect to the vertical axis of the bladed rotor.

19. The pellet dryer according to claim 14 wherein the outlet nozzles are inclined by the angle $\alpha$ of 45° in respect to the vertical axis of the bladed rotor.

* * * * *